US005898277A

United States Patent [19]

Farnsworth et al.

[11] Patent Number: 5,898,277

[45] Date of Patent: Apr. 27, 1999

[54] APPARATUS FOR CONTROLLING ILLUMINATION OF A FLUORESCENT LAMP

[75] Inventors: Thomas L. Farnsworth, Hartville; Elton T. Leppelmeier, Highland Heights, both of Ohio

[73] Assignee: National Biological ETA Systems Corporation, Twinsburg, Ohio

[21] Appl. No.: 08/815,385

[22] Filed: Mar. 11, 1997

Related U.S. Application Data

[63] Continuation-in-part of application No. 08/699,950, Aug. 20, 1996.

[51] Int. Cl.[6] ..... H05B 41/14

[52] U.S. Cl. ..... 315/200 A; 315/277; 315/241 S; 340/815.46

[58] Field of Search ..... 315/106, 200 A, 315/241 P, 241 S, 277, 161, 246; 340/815.46

[56] References Cited

U.S. PATENT DOCUMENTS

| | | | |
|---|---|---|---|
| 4,862,039 | 8/1989 | Kile et al. | 315/194 |
| 5,083,064 | 1/1992 | Jones, Sr. | 315/294 |
| 5,111,115 | 5/1992 | Ball et al. | 315/239 |
| 5,691,607 | 11/1997 | Zawislak et al. | 315/308 |

OTHER PUBLICATIONS

IES Lighting Handbook regarding light sources on pp. 8–32 and 8–120, date unknown.

*Primary Examiner*—Arnold Kinkead
*Attorney, Agent, or Firm*—Emerson & Associates; Roger D. Emerson; John M. Skeriotis

[57] ABSTRACT

An apparatus for controlling illumination of a fluorescent lamp is disclosed which includes two transformers for heating cathodes of the fluorescent lamp. Also included are two ballasts for ballasting the fluorescent lamp having an input adapted to receive a source of A-C power and an output coupled to the fluorescent lamp. The ballasts provide power to the fluorescent lamp in excess of a normal rated power of the fluorescent lamp. The apparatus further includes a flasher relay for repeatedly cycling power at a cycling rate between power on and power off to the fluorescent lamp coupled to the output of the ballasts and to the fluorescent lamp, thereby causing the fluorescent lamp to flash at a flashing rate with a flashing intensity of light output which is greater than the flashing intensity of output of the fluorescent lamp under normal continuous operation. A remote control sensor may be connected to the apparatus to switch the apparatus between the flashing cycle and normal continuous operation. The remote control sensor may also be used to the control the flashing rate of the flasher relay. An audio modulation apparatus may also be operatively connected to the flasher relay to control the flashing rate of the apparatus with an audio signal.

20 Claims, 5 Drawing Sheets

APPARATUS FOR CONTROLLING ILLUMINATION OF A FLUORESCENT LAMP

This is a continuation-in-part of application Ser. No. 08/699,950, filed Aug. 20, 1996.

BACKGROUND OF THE INVENTION

1. Field of Invention

This invention pertains to the art of methods and apparatuses for the control of electric discharge lamps, and more specifically to methods and apparatuses for the control of a fluorescent lamp that causes the lamp to periodically flash.

2. Description of the Related Art

In the past, control circuitry has been employed to cause a fluorescent lamp to flash by cycling the primary of the lamp ballast reactor at a desired cycle rate by turning the power "on" and "off" at the desired cycle rate. This results in the average lamp wattage output being below its normal wattage rating, generally in the 40%–60% range. This in turn results in a corresponding reduction in lumen output. In such flashing, the intensity or light output of each flash is approximately the same as its normal continuous light output. Additionally, the cathodes of the fluorescent lamp must be kept continuously heated in order to avoid early lamp "end blackening" and short lamp life.

Applicant recognized the need to create a flashing circuit that allowed the fluorescent lamp to be operated at higher wattage without detrimental effects to the life of the fluorescent lamp.

The present invention contemplates a new and improved control of a fluorescent lamp which is simple in design, effective in use, and overcomes the foregoing difficulties and others while providing better and more advantageous overall results.

SUMMARY OF THE INVENTION

In accordance with the present invention, a new and improved control of a fluorescent lamp is provided which relates to the use of lamp ballasting for operating fluorescent lamps intermittently. In intermittent or flashing operations, the fluorescent lamp is driven by a ballast or ballasts which is/are providing current and power at levels that are higher than the normal current and power required for continuous operation of the lamps. Over driving the lamp while periodically cycling the ballast secondary, i.e., power to the lamp, results in a corresponding increase in lumen output to produce higher intensity flashes than normal.

Over driving a lamp with voltage, causes a corresponding reduction in lamp life. However, this method of over driving the lamp with current does not produce a detrimental effect on lamp life. Furthermore, cycling or flashing of the lamp at a duty cycle proportional to the increase in current will produce an average power which is at or near the normal wattage rating for the lamp.

These and other objects may be accomplished by a system for controlling fluorescent lamp illumination comprising: a heating means for heating cathodes of the fluorescent lamp; a lamp ballast means, having an input adapted to receive a source of A-C power and an output coupled to the lamp, for providing power to the lamp in excess of the lamp's normal rated power; a means coupled to the output of the ballast means and to the lamp for repeatedly cycling the power on and off to the lamp, thereby causing the lamp to flash, and wherein the flashing intensity of the light output is greater than the lamp intensity under normal continuous operation.

These and other objects may also be accomplished by a system for controlling the operation of a fluorescent lamp having two cathodes, comprising: first and second ballasts, each ballast having a primary adapted for receiving a source of A-C power wherein such primaries are connected in parallel, each ballast further comprising a secondary wherein such secondaries are connected in parallel, the secondaries of the ballasts are coupled to the cathodes of the lamp, and wherein the first ballast has a power output substantially equal to that of the lamp; a flashing circuit, coupled to the secondaries of the ballasts and the lamp, for repeatedly engaging and disengaging power to the lamp to cause the lamp to flash.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
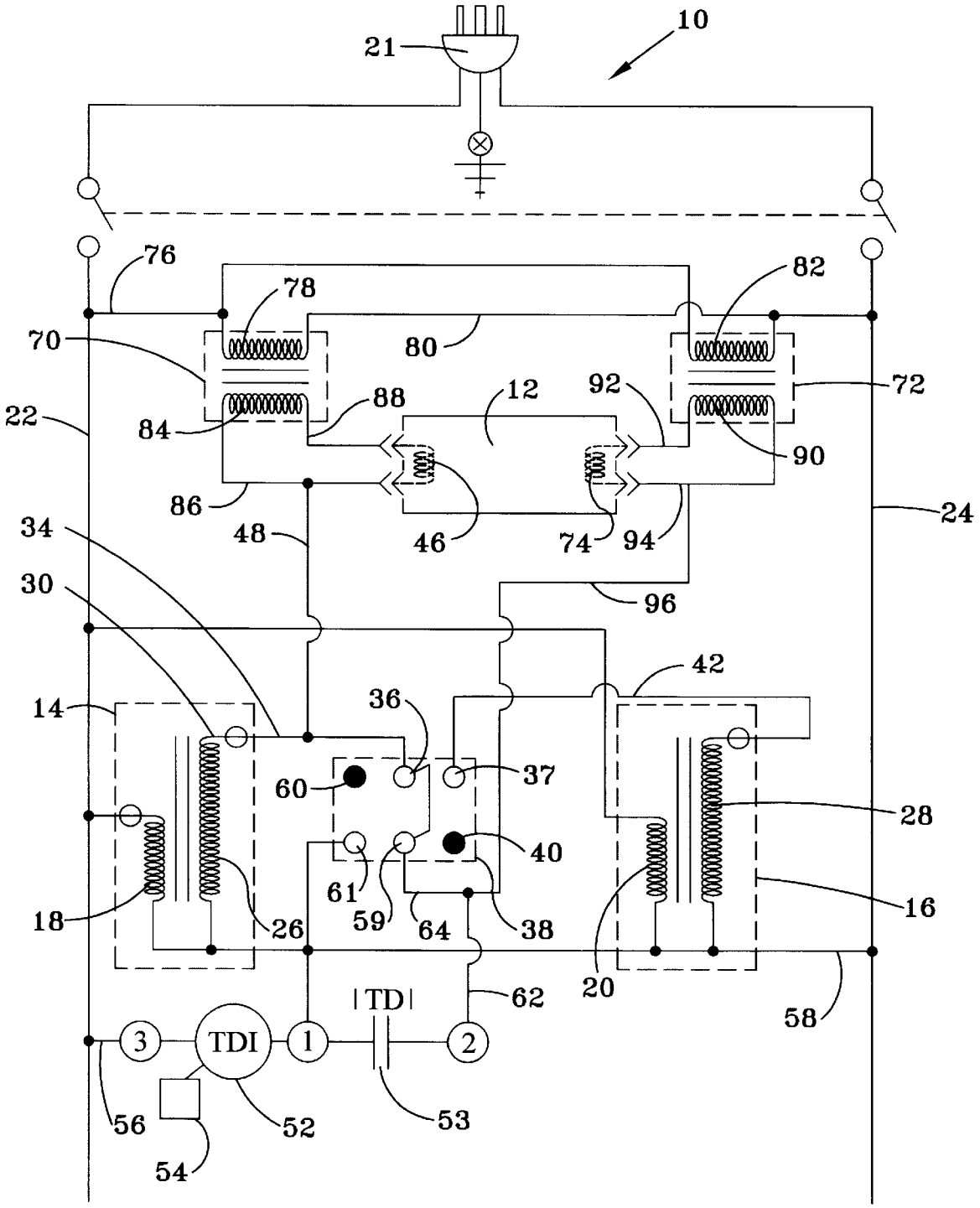
FIG. 1 is a schematic wiring diagram illustrating one embodiment of the invention for operating a fluorescent lamp.

Referring now to the drawings wherein the showings are for purposes of illustrating a preferred embodiment of the invention only and not for purposes of limiting the same, FIG. 1 shows a lamp flashing circuit, referred to generally as reference 10, for causing a fluorescent lamp 12 to operate intermittently or to flash. In general, lamp 12 may comprise an ordinary rapid start fluorescent lamp.

The flashing circuitry 10 includes a pair of ballasts 14,16 connected in parallel. The primary winding 18 of the first ballast 14 and the primary winding 20 of the second ballast 16 are each coupled to a source of AC power 21 via lines 22 and 24.

The secondary winding 26 of the first ballast 14 is coupled to a double pull double throw switch 38. Specifically, the output 30 of secondary winding 26 is coupled to a pole 36 of the strobe contact 40 of the double pull double throw switch 38 via line 34. The other pole 37 of the strobe contact 40 of the switch 38 is coupled to the secondary winding 28 of the second ballast 16, via line 42.

The output of the ballast 14, as well as the pole 36 of the strobe contact 40 of switch 38, are coupled to cathode 46 of lamp 12 via line 48.

Relay flasher 52 is provided with an input device 54 for adjusting the rate at which the relay flasher 52 opens and closes and a relay contact 53 for opening a closing the flashing circuit 10. The relay flasher 52 is coupled to the source of A-C power 21 via lines 56 and 58. The output of relay flasher 52 is also coupled to a terminal 59 of the switch 38 via lines 62 and 64 and relay contact 53. The other terminal 61 of steady contact 60 is coupled to line 24, which is normally the primary neutral.

There is further provided two transformers 70,72 for providing power to cathodes 46 and 74 respectively, of the lamp 12. The first input 76 of the primary winding 78, of transformer 70 is coupled to primary line 22, while the second input 80 is coupled to primary line 24. The primary winding 78 of transformer 70 is also connected in parallel to the primary winding 82 of transformer 72. The secondary winding 84 of transformer 70 is coupled to the cathode 46 of the lamp 12 via lines 86 and 88. Similarly, the secondary winding 90 of transformer 72 is coupled to the cathode 74 of lamp 12 via lines 92 and 94.

If the switch 38 is thrown to the steady contact 60 of switch 38, relay contact 53 is shorted out and the lamp 12 is powered continuously. In operation, the output of secondary winding 84 of transformer 70 provides power to the cathode 46 of lamp 12 so that it is heated, to provide a free source of electrons, common in the operation of fluorescent lamps. Similarly, the secondary winding 90 of transformer 72 provides a source of power to heat cathode 74 of lamp 12. The ballast 14,16 provides the required starting voltage across cathodes 46 and 74 of lamp 12 while limiting the current to the lamp 12 as the resistance of the lamp 12 decreases during energization. As is well known, a ballast must provide the required starting voltage in order to draw an arc within the lamp to cause it to energize or light while also limiting the current supplied to the lamp. The ballasts 14,16 illustrated herein limit the current through the use of an auto-transformer in parallel with a capacitor. However, it is readily understood that other common type ballasts may be employed, such as those ballasted by inductance or resistance.

When the switch 38 is thrown to the strobe contact 40, The ballasts 14 and 16 apply a voltage, from the secondary windings 26 and 28 to the cathode 46, via line 48 and to cathode 74 via lines 24,58,62 and 96 with the relay contact 53 of relay flasher 52 closed. This causes the arc to be established within the lamp 12, thus causing the lamp 12 to become energized. When the flashing contact 53 is open, power is not supplied by the flashing circuit 10 to the lamp 12, and the lamp 12 is not energized.

Ballasts 14 and 16 together provide flashing power which is above the normal wattage rating of the lamp 12. In this particular embodiment, each ballast 14,16 is sized to provide power and current that is about that of the normal power and current rating of the lamp 12. In other words, the fluorescent lamp 12 is intermittently operated at twice its normal power rating. If the flasher circuit 10 operates to intermittently operate (flash) the lamp 12 at a duty cycle in the range of about 40% to 60% of the time. This in turn, allows the lamp 12 to operate, on average at 80 to 120% of its rated normal power during a cycle. Thus, at a 50% duty cycle, about twice the flashing intensity can be achieved at about the same average power as would be used during continuous operation.

With at last one of the ballasts 14,16 rated for the continuous power requirements of the lamp 12, such as ballast 14, the lamp 12 can easily be switched from flashing made to continuous operation. Actuating switch 38, causes strobe contact 40 to open while closing steady contact 60. This bypasses both the relay contact 53, as well as ballast 14 to drive the lamp 12 in continuous operation.

While certain representative embodiments and details have been shown for the purpose of illustrating the invention, it will be apparent to those skilled in the art that various changes and modifications may be made therein without departing from the scope of the invention. For example, other flashing power levels can be obtained by using different current/wattage rated ballasts 14,16 either singly or in parallel, as long as the ballasts 14,16 are capable of providing the required lamp 12 starting and operating volts. Furthermore, the ballasts 14,16 are not limited to electromagnetic ballasts, but could also be electronic ballasts.

Figure 2:
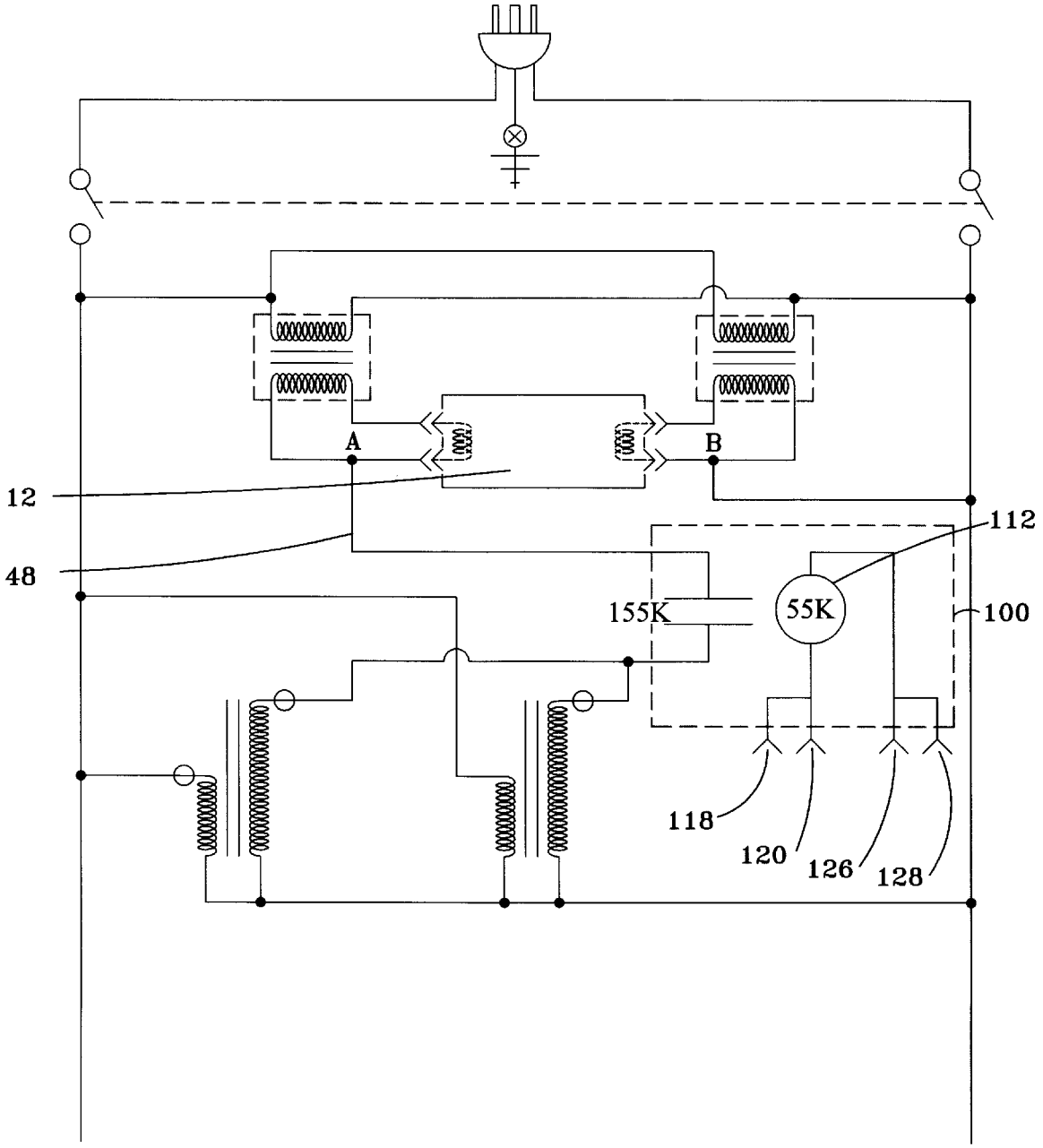
FIG. 2 is a schematic wiring diagram illustrating an alternate embodiment of the invention for operating a fluorescent lamp utilizing a remote control apparatus.

With reference to FIG. 2, the switch 38 and relay flasher 52 may be replaced by a remote control sensor 100. The remote control sensor 100 is preferably of the type well known in the art. The remote control sensor 100 includes a relay contact 106 located along line 48. Relay contact 106 opens and closes to cause the flashing circuit to open and close and the lamp 12 to flash. The relay contact 106 is preferably a solid-state relay that includes a triac. The remote control sensor 100 also includes a solid-state coil 112 that operates the relay contact 106. The remote control sensor 100 receives input through input jacks 118,120 from a remote control unit (not shown). A second pair of jacks 126,128 enable the flashing circuit 10 to be connected to additional units (not shown). The flashing circuit 10 may be daisy-chained with other units so that a single remote control unit can control each unit simultaneously. Remote control sensor 100 enables a user, through a remote control unit, to adjust the rate at which the relay contact 106 opens and closes, thereby adjusting the strobe flash rate of the lamp 12.

Figure 3:
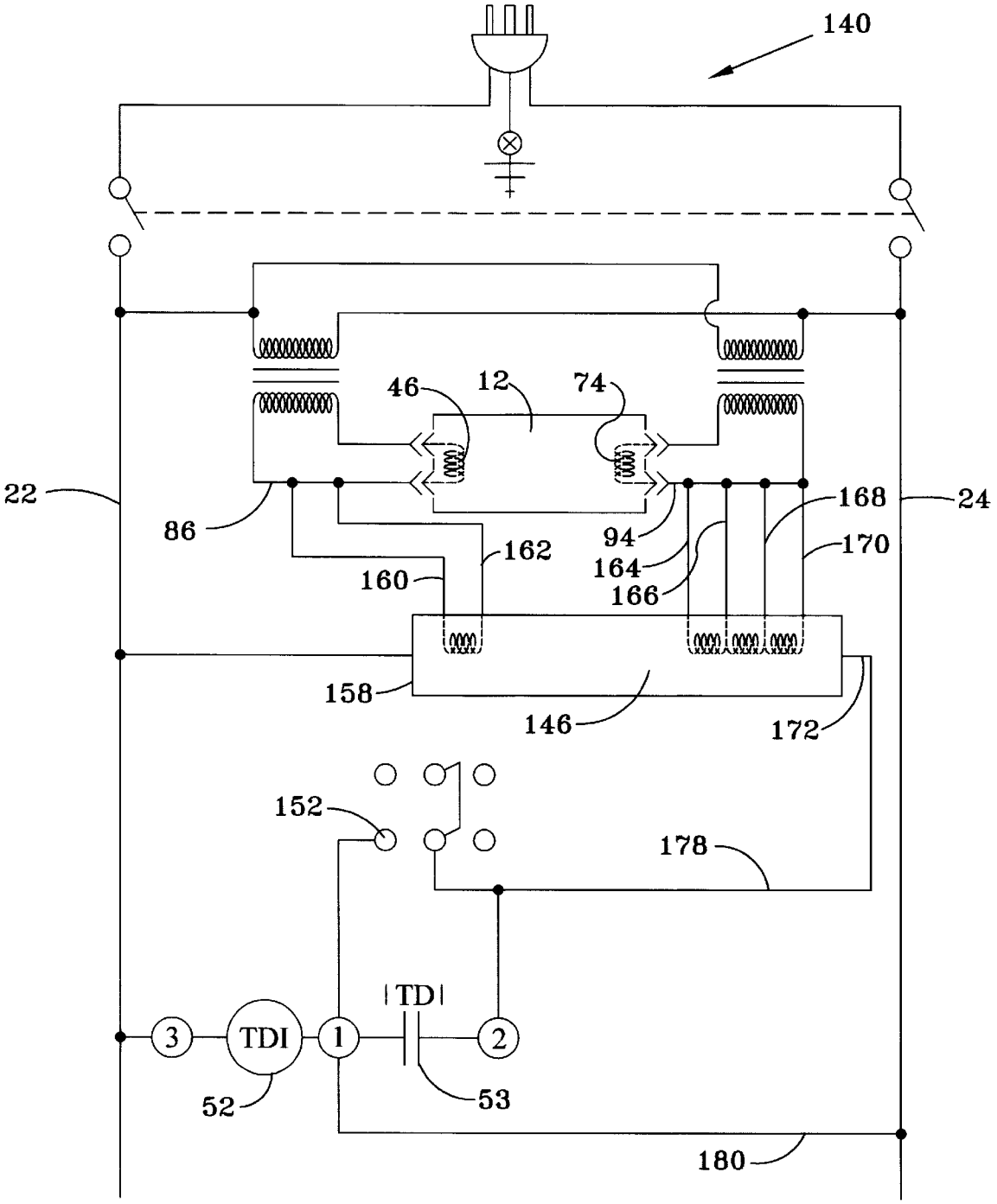
FIG. 3 is a schematic wiring diagram illustrating another embodiment of the invention for operating a fluorescent lamp with an electronic ballast.

FIG. 3 shows a schematic of an alternative flashing circuit 140 for flashing a fluorescent lamp 12 using an electronic ballast 146. The relay flasher 52 drives a relay contact 53 that may be bypassed by switch 38. When the switch 38 contacts the terminal 152, the relay contact is shorted and the electronic ballast 146 powers the lamp 12 steadily. The electronic ballast 146 has eight contacts. A black contact 158 is connected to power line 22. The two yellow contacts 160,162 are connected to one cathode 46 of the lamp 12 via line 86. The two red contacts 166,168 and the two blue contacts 168,170 are connected to the other cathode 74 of the lamp 12 via line 94. The white contact 172 is connected to the second power line 24 via lines 178,180 and switch 38. When switch 38 is thrown to contact terminal 152, relay contact 53 is shorted and the white contact 172 is steadily contacted to line 24. When the switch 38 is not thrown to contact terminal 152, the relay contact 53 is not shorted, and the relay contact 53 opens and closes at a rate determined by the relay flasher 52, thereby causing power to go on and off to the electronic ballast 146 and causing the lamp 12 to flash.

Figure 4:
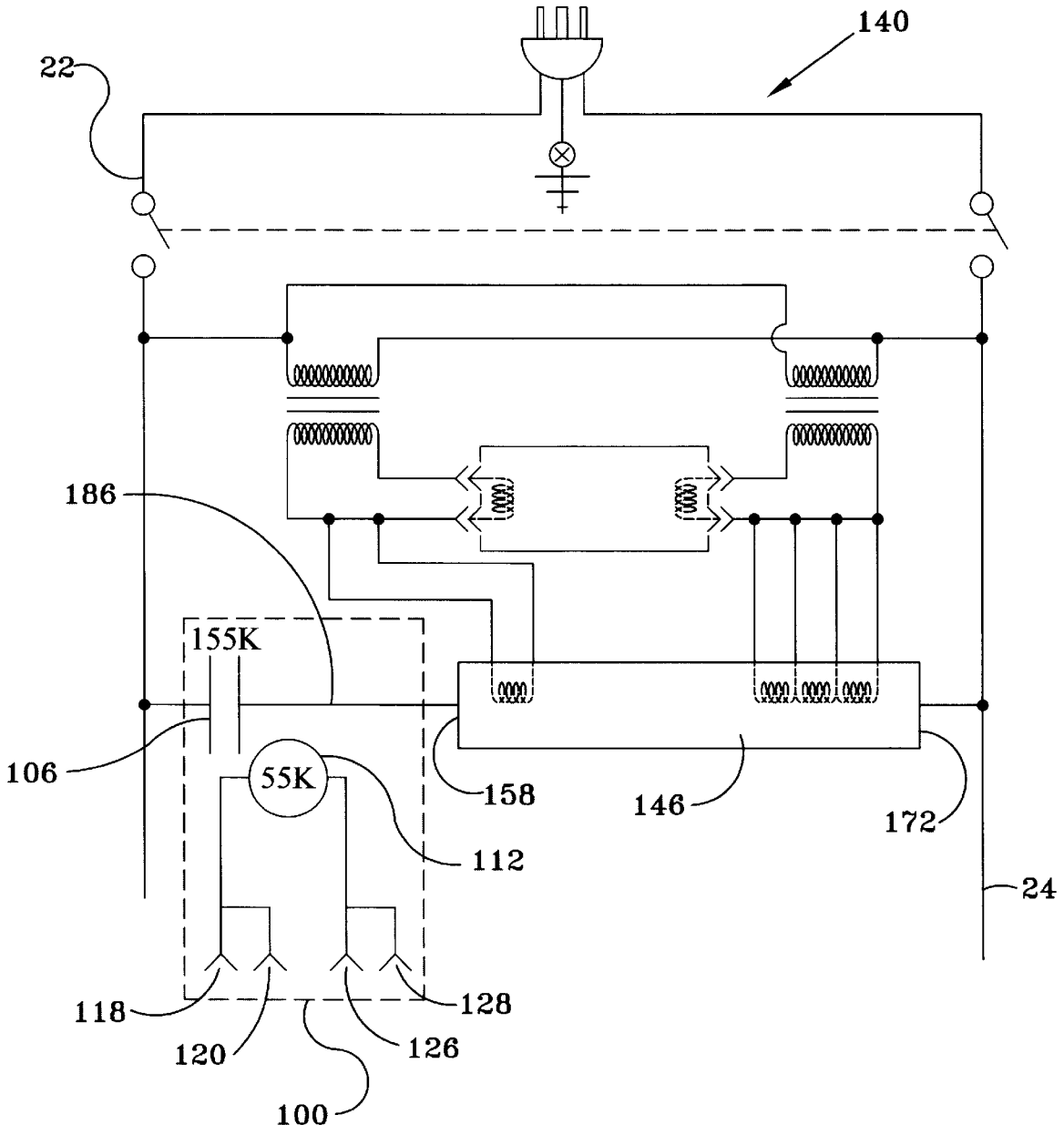
FIG. 4 is a schematic wiring diagram illustrating an alternate of the embodiment of FIG. 3 utilizing a remote control apparatus; and, FIG. 5 is a schematic wiring diagram of a remote control apparatus.

FIG. 4 shows an alternate embodiment of flashing circuit 140 with a remote control sensor 100. The white contact 172 is directly connected to power line 24. The solid-state relay contact 106 of the remote control sensor 100 is located along line 186 connecting the black contact 158 of the electronic ballast 146 to power line 22. As with the remote control sensor of FIG. 2, the relay contact 106 is opened and closed by a solid-state coil 112 directed by input received from a remote control apparatus (not shown) through input jacks 118,120. Jacks 126,128 allow the flashing circuit 140 to be daisy chained with additional units.

Figure 5:
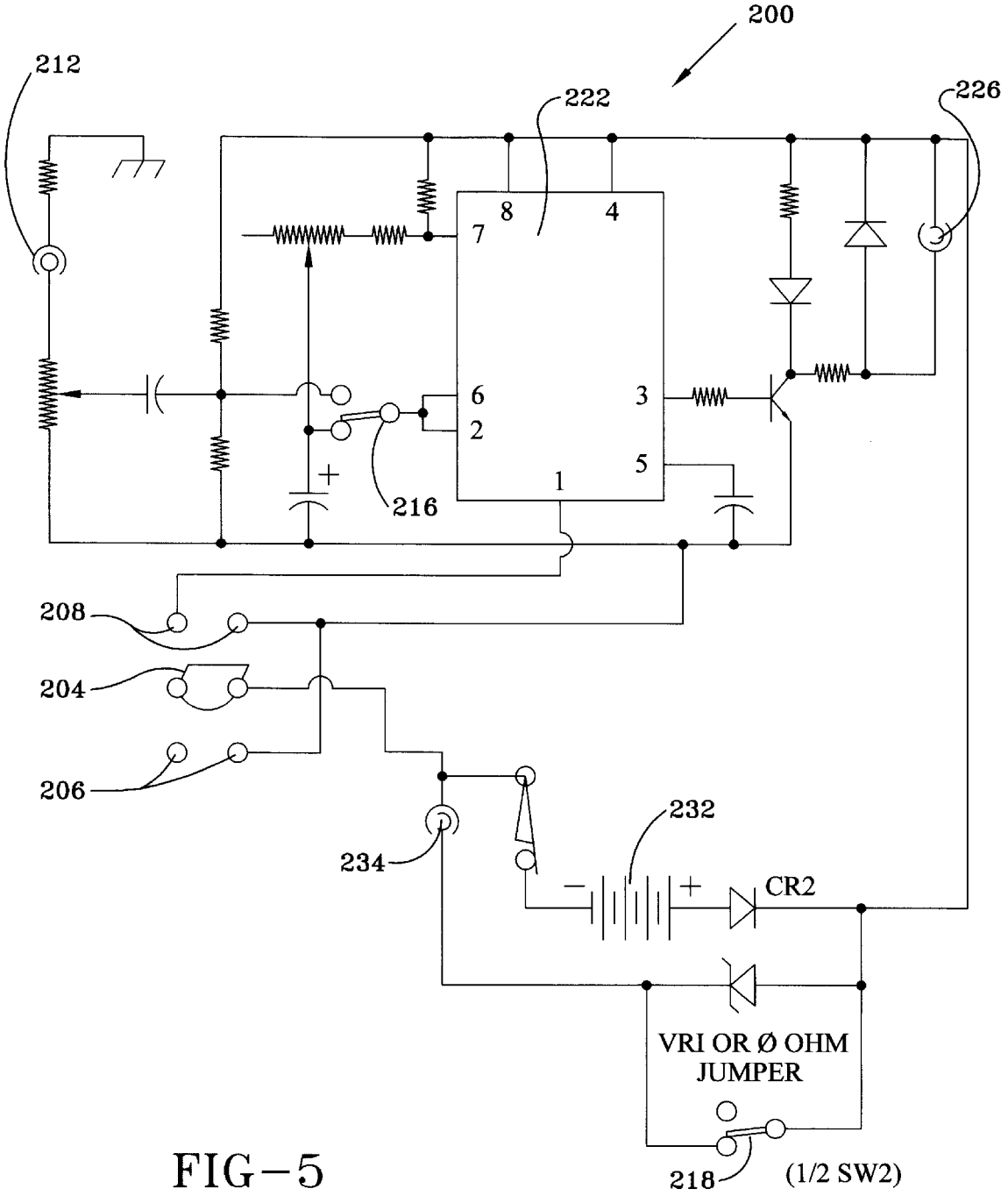

With continuing reference to FIGS. 2 and 4, FIG. 5 shows a schematic circuit diagram of a remote control apparatus 200 which is well known in the art. The remote control apparatus 200 directs the relay flasher solid-state coil 112 and the solid-state relay contact 106 to flash the lamp 12 in synchronization with a flash signal. The remote control apparatus 200 may produce a steady signal if the switch 204 is thrown to contact the steady contact 206. The remote control apparatus 200 may also produce a signal that directs the flashing circuits 10,140 to strobe when the switch 204 is thrown to contact the strobe contact 208. The signal produced is preferably a square wave output between 3 volts and 20 volts, preferably between 9 volts and 15 volts. The signal produced may vary between 0.5 Hz and 40 Hz. If the signal produced has a frequency greater than 40 Hz, the human eye may not be able to detect the strobe effect. Typical fluorescent lamps 12 flash normally at a rate of 60 Hz under normal operation. The strobe contact may also be connected to an audio input 212 to create audio-modulation that directs the relay contact 106 to close when an input signal, such as music, is detected, and to open when the input signal is not detected. The lamp 12 would then light when an input signal was detected by the remote control apparatus 200 and the relay contact 106 closed. The lamp 12 would be turned off when no input signal was detected by the remote control apparatus 200 106 and the relay contact 106 opened. Audio input 212 may be bypassed or connected by throwing switches 216,218. A 555 Timer Chip 222 produces the square wave signal that is sent to the output jack 226. The output jack is connected via wires (not shown) to the input jacks 118,120 of the remote control sensor 100. The remote control apparatus is preferably powered by a 9 volt battery 232 or a low voltage direct current power supply provided from power jack 234. Low voltage DC power is preferred for the operation of the remote control apparatus 200 and the square wave signal sent to the remote control sensor 100 and other units as a matter of safety over using higher voltage AC currents.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. An apparatus for controlling illumination of a fluorescent lamp, comprising:

heating means for heating cathodes of said fluorescent lamp;

ballast means for ballasting said fluorescent lamp having an input adapted to receive a source of A-C power and an output coupled to said fluorescent lamp, said ballast means providing power to said fluorescent lamp in excess of a normal rated power of said fluorescent lamp;

cycling means for repeatedly cycling power at a cycling rate between power on and power off to said fluorescent lamp coupled to the output of said ballast means and to said fluorescent lamp, thereby causing said fluorescent lamp to flash at a flashing rate with a flashing intensity of light output which is greater than the flashing intensity of light output of said fluorescent lamp under normal continuous operation;

additionally, cycling of the lamp at a duty cycle proportional to an increase in current will produce an average power which is at or near the normal wattage rating for the lamp; and, remote sensing means for receiving remote signals from a remote control unit, said remote sensing means being operatively connected to said cycling means.

2. The apparatus of claim 1 wherein said ballast means comprises two reactive ballasts coupled in parallel.

3. The apparatus of claim 1 wherein said cycling means comprises varying means for varying said cycling rate such that said flashing rate of said fluorescent lamp varies.

4. The apparatus of claim 2 wherein each of said two reactive ballasts has a power output equal to said normal rated power of said fluorescent lamp.

5. The apparatus of claim 4 further comprising a switch having a first position and second position, said first position engaging said cycling means such that said fluorescent lamp flashes, said second position disengaging said cycling means such that said fluorescent lamp operates continuously.

6. The apparatus of claim 3 further comprising remote sensing means for receiving remote signals from a remote control unit, said remote sensing means being operatively connected to said varying means to remotely vary said flashing rate.

7. The apparatus of claim 3 further comprising audio modulation means for flashing said fluorescent lamp in synchronization with an audio input signal, said audio modulation means being operatively connected to said varying means to vary said flashing rate in synchronization with said audio input signal.

8. The apparatus of claim 1 further comprising connecting means for connecting said apparatus and said remote control unit to at least one additional apparatus for controlling illumination of at least one additional fluorescent lamp, said remote control unit directing said apparatus and said at least one additional apparatus to flash said fluorescent lamp and said at least one additional fluorescent lamp simultaneously.

9. An apparatus for controlling the operation of a fluorescent lamp having a first cathode and a second cathode and a normal power rating, comprising:

a first ballast and a second ballast, said first ballast having a first primary and said second ballast having a second primary adapted for receiving a source of A-C power wherein said first prior and said second primary are connected in parallel, said first ballast having a first secondary and said second ballast having a second secondary wherein said first secondary and said second secondary are connected in parallel, said first secondary and said second secondary being coupled to said first cathode and said second cathode of said fluorescent lamp, said first ballast having a power output substantially equal to said normal power rating of said fluorescent lamp;

a flashing circuit coupled to said first secondary and said second secondary, said flashing circuit repeatedly engaging and disengaging power to said fluorescent lamp and causing said fluorescent lamp to flash at a flashing rate; and, audio modulation means for flashing said fluorescent lamp in synchronization with an audio input signal, said audio modulation means being operatively connected to said flashing circuit to vary said flashing rate in synchronization with said audio input signal; and, additionally, cycling of the lamp at a duty cycle proportional to an increase in current will produce an average power which is at or near the normal wattage rating for the lamp.

10. The apparatus of claim 9 wherein said flashing circuit varies said flashing rate to produce a duty cycle of between 40% and 60%.

11. The apparatus of claim 10 wherein said flashing circuit comprises a flasher relay.

12. The apparatus of claim 9 wherein said second ballast has a power output equal to said power output of said first ballast.

13. The apparatus of claim 9 further comprising a switch for selectively disengaging said second ballast and said flashing circuit such that said fluorescent lamp is driven continuously by said first ballast.

14. The apparatus of claim 12 further comprising a switch for selectively disengaging the second ballast and said flashing circuit such that said fluorescent lamp is driven continuously by said first ballast.

15. The apparatus of claim 14 further comprising a first transformer and a second transformer, said first transformer being coupled to said first cathode of said fluorescent lamp and said second transformer being coupled to said second cathode of said fluorescent lamp.

16. The apparatus of claim 9 further comprising remote sensing means for receiving remote signals from a remote control unit, said remote sensing means being operatively connected to said flashing circuit to remotely vary said flashing rate.

17. The apparatus of claim 16 further comprising connecting means for connecting said apparatus and said remote control unit to at least one additional apparatus for controlling illumination of at least one additional fluorescent lamp, said remote control unit directing said apparatus and said at least one additional apparatus to flash said fluorescent lamp and said at least one additional fluorescent lamp simultaneously.

18. The apparatus of claim 1 wherein said ballast means comprises an electronic ballast.

19. An apparatus for controlling illumination of a fluorescent lamp, comprising:

heating means for heating cathodes of said fluorescent lamp;

ballast means for ballasting said fluorescent lamp having an input adapted to receive a source of A-C power and an output coupled to said fluorescent lamp, said ballast means providing power to said fluorescent lamp in excess of a normal rated power of said fluorescent lamp;

cycling means for repeatedly cycling power at a cycling rate between power an and power off to said fluorescent lamp coupled to the output of said ballast means and to said fluorescent lamp, thereby causing said fluorescent lamp to flash at a flashing rate with a flashing intensity of light output which is greater than the flashing intensity of light output of said fluorescent lamp under normal continuous operation, said cycling means comprising varying means for varying said cycling rate such that said flashing rate of said fluorescent lamp varies;

audio modulation means for flashing said fluorescence lamp in synchronization with an audio input signal, said audio modulation means being operatively connected to said varying means to vary said flashing rate in synchronization with said audio input signal; and, additionally, cycling of the lamp at a duty cycle proportional to an increase in current will produce an average power which is at or near the normal wattage rating for the lamp.

20. An apparatus for controlling the operation of a fluorescent lamp having a first cathode and a second cathode and a normal power rating, comprising:

a first ballast and a second ballast, said first ballast having a first primary and second ballast having a second primary adapted for receiving a source of A-C power wherein said first primary and second primary are connected in parallel, said first ballast having a first secondary and said second ballast having a second secondary wherein said first secondary and said second secondary are connected in parallel, said first secondary and said second secondary being coupled to said first cathode and said second cathode of said fluorescent lamp, said first ballast having a power output substantially equal to said normal power rating of said fluorescent lamp;

a flashing circuit coupled to said first secondary and said second secondary, said flashing circuit repeatedly engaging and disengaging power to said fluorescent lamp and causing said fluorescent lamp to flash at a flashing rate;

remote sensing means for receiving remote signals from a remote control unit, said remote sensing means being operatively connected to said flashing circuit to remotely vary said flashing rate; and, additionally, cycling of the lamp at a duty cycle proportional to an increase in current will produce an average power which is at or near the normal wattage rating for the lamp.

* * * * *